United States Patent [19]

Christian

[11] 4,411,375

[45] Oct. 25, 1983

[54] NOVEL SHELF ARRANGEMENT FOR A DROP SHELF VENDING MACHINE

[76] Inventor: Donald K. Christian, 119 Woodbine Ter., Spartanburg, S.C. 29304

[21] Appl. No.: 66,481

[22] Filed: Aug. 13, 1979

[51] Int. Cl.[3] ..... G07F 11/06

[52] U.S. Cl. ..... 221/90

[58] Field of Search ..... 221/90, 89, 86, 82, 221/76

[56] References Cited

U.S. PATENT DOCUMENTS

| | | | |
|---|---|---|---|
| 464,067 | 12/1891 | Foster | 194/22 |
| 916,345 | 3/1909 | Martin | 221/90 |
| 1,026,919 | 5/1912 | Leemann | 221/90 |
| 1,256,071 | 2/1918 | Steiner | 194/79 |
| 2,361,977 | 11/1944 | Stair | 221/90 |
| 2,753,033 | 7/1956 | Fancher | 221/90 X |
| 2,816,688 | 12/1957 | Wolf | 221/90 X |
| 2,904,216 | 9/1959 | Poland | 221/90 |
| 3,946,846 | 3/1976 | Pepiciello et al. | 221/90 X |

FOREIGN PATENT DOCUMENTS

| | | | |
|---|---|---|---|
| 241958 | 12/1911 | Fed. Rep. of Germany | 221/90 |
| 273294 | 4/1914 | Fed. Rep. of Germany | 221/90 |

*Primary Examiner*—F. J. Bartuska

[57] ABSTRACT

A novel shelf arrangement for a drop shelf vending machine of the type used for newspapers and the like wherein the shelves are staggered or of varying width to suggest the loading or unloading of several shelves at any one given time.

3 Claims, 1 Drawing Figure

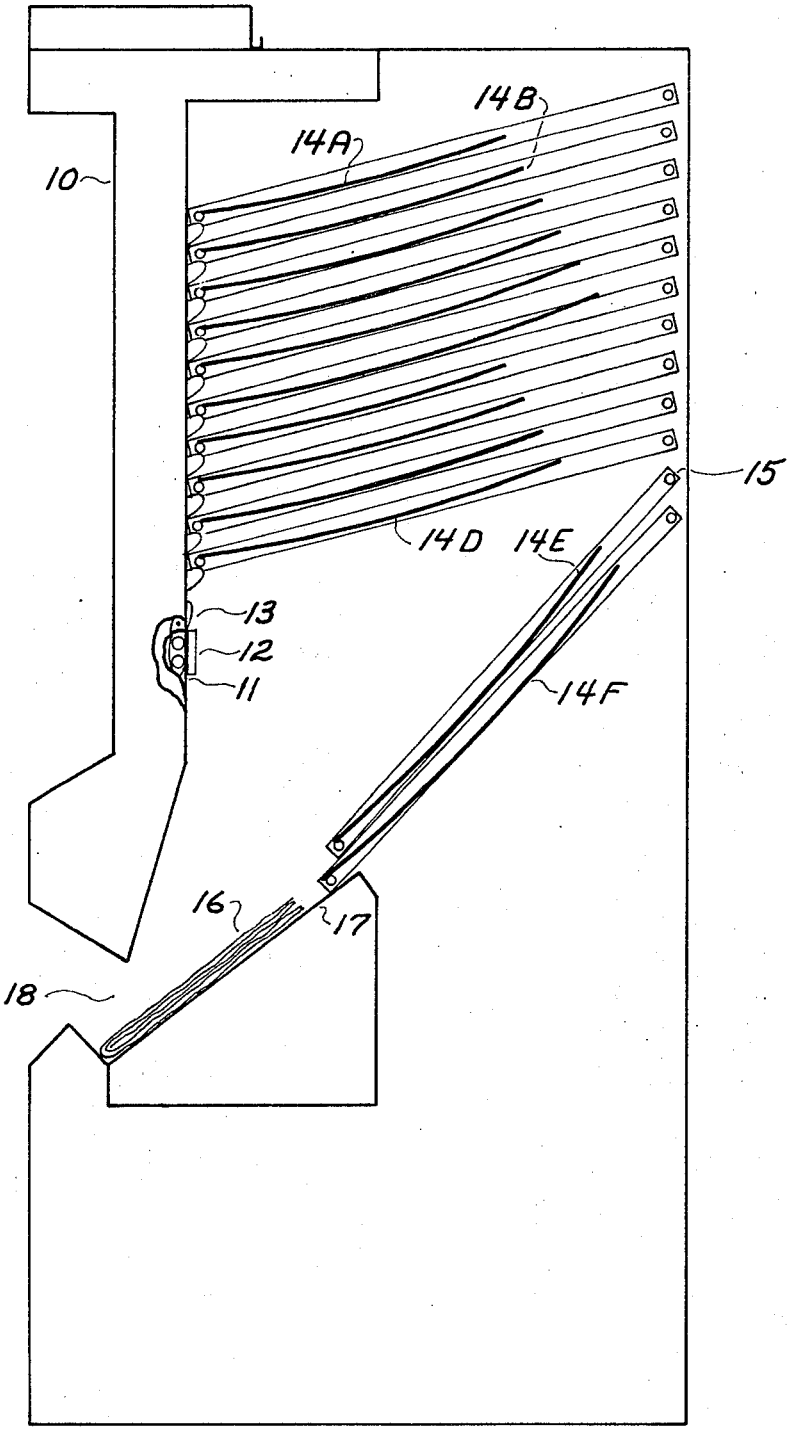
FIG. I

NOVEL SHELF ARRANGEMENT FOR A DROP SHELF VENDING MACHINE

BACKGROUND OF THE INVENTION

Numerous techniques have been heretofore devised for the vending of newspapers, magazines and the like. These techniques generally fall into two classifications: a) the semi honor system wherein the purchaser gains access to a plurality of papers and is trusted to remove only one and, b) the single copy system wherein the purchaser gains access to a single paper.

The former has become the more common because the value of the time required to load and unload the latter frequently exceeds the value of the merchandise losses experienced in the former. U.S. Pat. Nos. 464,067 Foster, 1,256,071 Steiner, 2,904,216 Poland and 3,946,846 Pepiciello all describe drop shelf newspaper periodical vending machines but none teach a shelf configuration which facilitates loading and unloading as does the present invention. Pepiciello in the above mentioned patent does recognize the problem and does teach an improved means of resetting the shelf release mechanism to reduce the servicing time, the present invention does substantially further reduce the servicing time by making it easier and thus quicker to remove outdated material and to reload the machine with new editions.

SUMMARY OF THE INVENTION

It is the object of the present invention to lower the labor costs of single copy vending to a point where it is economically feasable to use this system thus minimizing the current severe merchandise losses being experienced by the honor system.

Generally speaking, the apparatus of the present invention comprises a housing, one or more series of varying width dispensing shelves or racks, a shelf support/release means, a coin accepting means and appropriate linkage to operatively connect the coin accepting means to the shelf release means.

More specifically, the housing is adapted to accept a plurality of pivotally mounted drop shelves or racks, said shelves or racks are of varying width and so aligned as to encourage the loading of several shelves at any one given time or, of shelves or racks of the same width but mounted in a staggered manner to the same end. The shelves of the preferred embodiment are of six different widths (depths) and are arrainged in several groups of six shelves. Within each group any given shelf is narrower that the one below thus presenting a staggered set of six receptacles for a like number of papers. It is not to be understood that the invention is in anyway dependent upon the number six. Any number of shelves could be so grouped to the same effect. Said shelves of either design may be made narrower than the product for which they are intended thusly making it possible to grasp a multiplicity of products when unloading said shelves.

Anyone of a number of shelf support/release systems known to those skilled in the art can be employed to support the shelves. U.S. Pat. No. 3,946,846 Pepiciello describes a cable driven release means which is quite satisfactory, U.S. Pat. No. 2,361,977 Stair describes a series of tilt arm members activated by a chain mounted bracket, said chain thereof being suspended between an indexing drive shaft above and an idler below. This top would be compatable with the present invention. U.S. Patent Application No. 66,480 now U.S. Pat. No. 4,284,207 Christian which accompanies this application teaches yet another support/release means which has proven satisfactory.

A coin accepting mechanism is operatively connected to said shelf support/release means in one of any of a number of ways known to those skilled in the art. Above mentioned U.S. Pat. No. 3,946,846 aptly describes a manually releasable ratchet mechanism operatively linked to a reciprocating coin acceptor mechanism to index a shelf release means. The above mentionesd U.S. Pat. No. 2,361,977 teaches operatively connecting a chain driven release means to a rotatable knob coin mechanism. U.S. Pat. No. 2,753,033 Fancher teaches the use of a coin to operatively connect a rotatable shelf support/release means to a lever projecting from a drop shelf vending machine, this system too could be used in conjunction with the present invention. Any number of electrical coin mechanisms could also be used with appropriate magnetic actuator mechanisms.

BRIEF DESCRIPTION OF THE DRAWINGS

FIG. 1 is a cross sectional side view of the apparatus.

DESCRIPTION OF THE PREFERRED EMBODIMENTS

Making reference to the Figures, a specific embodiment of the present invention will now be described in detail.

Referring to FIG. 1, housing 10 contains a conventional coin acceptor mechanism and linkage operatively connected to index upwardly conveyance means 11, which is associated with shelf release means 12, thus removing shelf support means 13 from its position of support under shelf assembly 14-E. Said shelf assembly having been released by such action has fallen pivotally about pin 15 permitting newspaper 16 to fall down to slide 17 and on to vend access area 18. Shelf assemblies 14-A thru F all have progressively wider or deeper bottoms as indicated to facilitate the insertion of a paper on each of the six shelves in any given series at any given time.

Having described the present invention in its simplicity, it is obvious that a greater or smaller number of shelves may be used and it is equally obvious that one skilled in the art will be able to make modifications and variations thereto without departing from the scope of the invention. Accordingly, the scope of the present invention should be determined by the claims appended hereto.

What is claimed is:

1. A vending machine including a plurality of varying width dispensing shelves, pivotally mounted at one side and, a shelf support system comprised of a plurality of shelf support means for supporting said shelves at a side other than said one side, said shelves being so oriented as to facilitate the loading of more than one shelf at a time.

2. A vending machine as described in claim 1 wherein the shelves are narrower than the product for which they are designed so as to permit the grasping of the contents of more than one shelf at any given time thus facilitating the removal of unsold products.

3. A vending machine as described in claim 1 which is a newspaper vending machine.

* * * * *